US008327474B2

(12) United States Patent
Van Zeeland et al.

(10) Patent No.: US 8,327,474 B2
(45) Date of Patent: Dec. 11, 2012

(54) MAGNETIC DRAIN STOPPER ASSEMBLY

(76) Inventors: Anthony J. Van Zeeland, Mesa, AZ (US); Ryan M. Sims, Mesa, AZ (US)

( * ) Notice: Subject to any disclaimer, the term of this patent is extended or adjusted under 35 U.S.C. 154(b) by 798 days.

(21) Appl. No.: 12/342,371

(22) Filed: Dec. 23, 2008

(65) Prior Publication Data

US 2010/0154114 A1 Jun. 24, 2010

(51) Int. Cl.
*E03C 1/23* (2006.01)

(52) U.S. Cl. ..... 4/692; 4/295

(58) Field of Classification Search ..... 4/689–692, 4/684–685, 289, 295, 688, 693
See application file for complete search history.

(56) References Cited

U.S. PATENT DOCUMENTS

| | | | | | |
|---|---|---|---|---|---|
| 1,597,459 | A * | 8/1926 | Muend | 4/691 |
| 2,962,593 | A * | 11/1960 | Thomas | 313/7 |
| 3,245,425 | A * | 4/1966 | De Meyer et al. | 137/86 |
| 3,353,192 | A * | 11/1967 | Christiansen | 4/692 |
| 3,652,054 | A * | 3/1972 | Layton | 251/65 |
| 3,731,326 | A * | 5/1973 | Politz | 4/692 |
| 4,218,785 | A * | 8/1980 | Crawford et al. | 4/692 |
| 4,865,915 | A * | 9/1989 | Okonogi et al. | 428/336 |
| 4,903,943 | A * | 2/1990 | Hochstrasser | 251/235 |
| 4,932,082 | A * | 6/1990 | Ridgeway | 4/287 |
| 5,117,213 | A * | 5/1992 | Kreuter et al. | 335/219 |
| 5,208,921 | A * | 5/1993 | Nicoll | 4/286 |
| 5,363,519 | A * | 11/1994 | Husting | 4/689 |
| 5,640,724 | A * | 6/1997 | Holmes | 4/689 |
| 6,263,520 | B1 * | 7/2001 | Song | 4/325 |
| 6,282,730 | B1 * | 9/2001 | Duncan | 4/287 |
| 6,695,348 | B2 * | 2/2004 | Holly | 280/763.1 |
| 6,964,111 | B1 * | 11/2005 | Duffield | 33/478 |
| 7,530,123 | B2 * | 5/2009 | Cao et al. | 4/693 |
| 2005/0213201 | A1 * | 9/2005 | Zimmermann et al. | 359/368 |
| 2007/0241106 | A1 * | 10/2007 | Deg | 220/230 |
| 2008/0098516 | A1 | 5/2008 | Cao et al. | |
| 2009/0255041 | A1 * | 10/2009 | Duncan | 4/295 |
| 2010/0154114 | A1 * | 6/2010 | Van Zeeland et al. | 4/689 |
| 2011/0185494 | A1 * | 8/2011 | Beck et al. | 4/689 |

OTHER PUBLICATIONS

Magnetrol, J52 Refrigerant Level Switches, Aug. 2006, Magnetrol International, Incorporated.*

Magnetrol International Incorporated, Magnetrol J52 Refrigerant Level Switches, Bulletin: 46-122.4, Effective: Dec. 2000, Supersedes: Jun. 1997.*

* cited by examiner

*Primary Examiner* — Robert Canfield
*Assistant Examiner* — Brent W Herring
(74) *Attorney, Agent, or Firm* — Cook Alex Ltd.

(57) ABSTRACT

A magnetic drain stopper assembly includes an actuating lever in a drain pipe and is movable to allow fluid flow into the drain pipe in an open position and to prevent fluid flow into the drain pipe in a closed position. A magnet on the drain stopper interacts magnetically with the actuating lever or a sleeve on the actuating lever. The magnetic drain stopper is easily removed by simply pulling it out of the drain pipe. Studs on the drain stopper catch objects that fall into the drain pipe for easy retrieval and further catch residue such as hair for easy cleaning.

13 Claims, 10 Drawing Sheets

MAGNETIC DRAIN STOPPER ASSEMBLY

BACKGROUND OF THE INVENTION

This invention concerns a drain stopper for use in a drain pipe. More particularly, this invention pertains to a reciprocably operable drain stopper, such as a drain stopper for a bathroom sink. Drain stoppers are typically operated by an actuating lever extending into the interior of the drain pipe. The actuating lever has a ball joint that acts as a fulcrum to allow a range of movement of the actuating lever. The ball joint is held in place by a threaded retaining collar which joins a threaded socket formed on the outside of the drain pipe. An internal portion of the actuating lever is mechanically fastened to a loop or stirrup formed at or near the bottom of the drain stopper. An external portion of the actuating lever is attached to a linkage that includes an operating rod which is capable of being pushed and pulled through a range of motion. The drain stopper is in a closed position at one end of the range of motion and in an open position at the other end of the range of motion of the operating rod.

It is often desired to remove the drain stopper from the drain pipe to provide access for cleaning out the drain or retrieving an object that dropped down into the drain pipe. The mechanical linkage of the typical drain stopper prevents the drain stopper from being readily removed from the drain. To remove the drain stopper, one must typically access the actuating lever from beneath the sink. The operating rod must be disengaged from the actuating lever. Then the actuating lever's retaining collar must be unscrewed and removed from the socket of the drain pipe. Next the actuating lever and its ball joint are pulled out of the drain pipe. Only then can the drain stopper be pulled out of the drain pipe. Reassembly of the mechanical linkage is even more taxing as it typically requires several attempts at blindly threading the actuating lever through the stirrup on the drain stopper while it sits in the drain pipe, resulting in wasted time, frustration and, on occasion, unleashing of epithets.

It is also often desired to have a filtering structure in a drain pipe to trap residue such as hair and to catch objects that fall into the drain pipe. Typically, residue and objects in the drain pipe are removed by disassembling portions of the piping, such as a J-trap or the like, below the sink to provide access to the residue to be cleaned or the objects to be retrieved. This process is messy, time consuming and altogether unsatisfying to the unlucky soul charged with performing it.

Magnetically actuated drain stoppers have been developed. U.S. Pat. No. 5,208,921 discloses a magnetic drain stopper that includes a magnet within a hollow cylinder that fits within a drain pipe. A magnetic actuator is positioned outside the drain pipe and the actuator is manipulated by a rod to open and close a closure member on the hollow cylinder. In addition, U.S. Pat. No. 5,640,724 discloses a magnetically activated drain plug that includes a permanent magnet on the end of a drain plug and another permanent magnet assembled externally to the drain pipe. The external magnet is manipulated by a lever linkage or a flexible cable to open and close the drain plug. U.S. Pat. No. 6,282,730 is similar in that a magnet external to the drain pipe is manipulated by a linkage to cause a magnet inside the pipe to move between open and closed positions.

While these drain plug arrangements may work, they are not cost effective because they require specialized external actuating linkages. The use of such linkages also means they cannot be used to retrofit existing sinks without excessive expense. It would be preferable to have a magnetic drain stopper assembly that does not require an external magnet or any specialized actuating linkages, but instead uses the existing actuating lever of standard drain stoppers. What is further desirable is a filtering structure on the magnetic drain stopper that can trap residue and objects dropped into the drain pipe. The magnetic drain stopper assembly must be cost effective and easy to use. Also, the magnetic drain stopper assembly should be easy to install and easy to remove.

SUMMARY OF THE INVENTION

The present invention concerns a magnetic drain stopper assembly that can be easily removed from a drain pipe without disassembly or alteration of the standard actuating linkage. The magnetic drain stopper assembly of the present invention meets the objectives previously set forth. The magnetic drain stopper assembly can be used in any drain pipe where an actuating lever is used. It is particularly suited for use in replacing a handle-operated drain stopper, although it could be used in a wide variety of other applications as well.

One embodiment of the magnetic drain stopper assembly has a drain stopper sized to fit the drain pipe in which it is to be used. A magnet is attached at or near the base of the drain stopper. The magnet can be exposed, coated with a waterproof material, or encapsulated within the body of the drain stopper. The magnet interacts magnetically with an existing actuating lever that is typically made of steel. An existing operating rod that is connected to the actuating lever is manipulated to cause the actuating lever to move back and forth. As the actuating lever moves back and forth, the drain stopper moves between a closed position and an open position. The drain stopper can be removed from the drain pipe by simply pulling the drain stopper out because the drain stopper is not mechanically attached to the actuating lever. Similarly, the drain stopper can be reinstalled by simply dropping the drain stopper into the drain pipe.

Another embodiment of the magnetic drain stopper assembly further includes a sleeve for an actuating lever where the sleeve is made of a magnetic material such as steel. The magnetic sleeve is placed over an actuating lever that is made of a non-magnetic material such as plastic or aluminum. Alternatively, the covering can be a magnet and the drain stopper can contain a magnetic material such as steel.

In yet another embodiment the sleeve that goes over the actuating lever is a magnet and the drain stopper contains a magnet. Both the magnet of the drain stopper and the actuating lever covering magnet are polarized to be attracted to each other. Alternatively, both the magnet of the drain stopper and the actuating lever covering magnet can be polarized to repel each other.

In another embodiment, filter studs extend out from the body of the drain stopper. The studs are perpendicular to the body of the drain stopper and are positioned to catch residue such as hair and dropped objects such as jewelry. Alternatively, the studs can extend from the body of the drain stopper at an angle other than perpendicular.

In yet another embodiment, a kit is provided for replacing a typical handle-operated drain stopper with a magnetic drain stopper assembly. The kit includes a magnetic drain stopper that interacts magnetically with the existing actuating lever that is made of a magnetic material such as steel.

A further embodiment is a kit that includes a magnetic drain stopper assembly and a sleeve made of a magnetic material that goes over the existing actuating lever. This kit is used for replacing a typical handle-operated drain stopper where the existing actuating lever is made of a non-magnetic material. Alternatively, the sleeve can be made of a magnet.

Yet another embodiment is a method for replacing an existing handle-operated drain stopper with a magnetic drain stopper assembly where the existing actuating lever is made of a magnetic material. An alternative method replaces an existing handle-operated drain stopper with a magnetic drain stopper assembly where the existing actuating lever is made of a non-magnetic material.

DETAILED DESCRIPTION OF THE INVENTION

Figure 1:
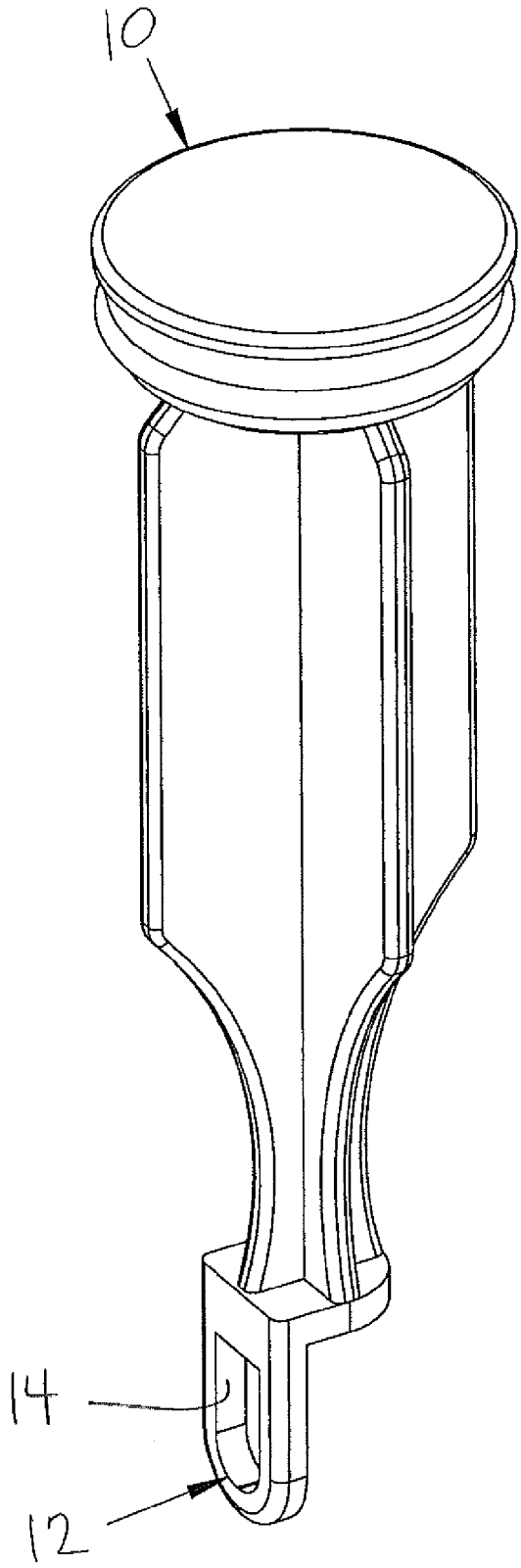
Figure 1 (Prior Art)
FIG. 1 is a perspective view of a prior art embodiment of a drain stopper.
Figure 2:
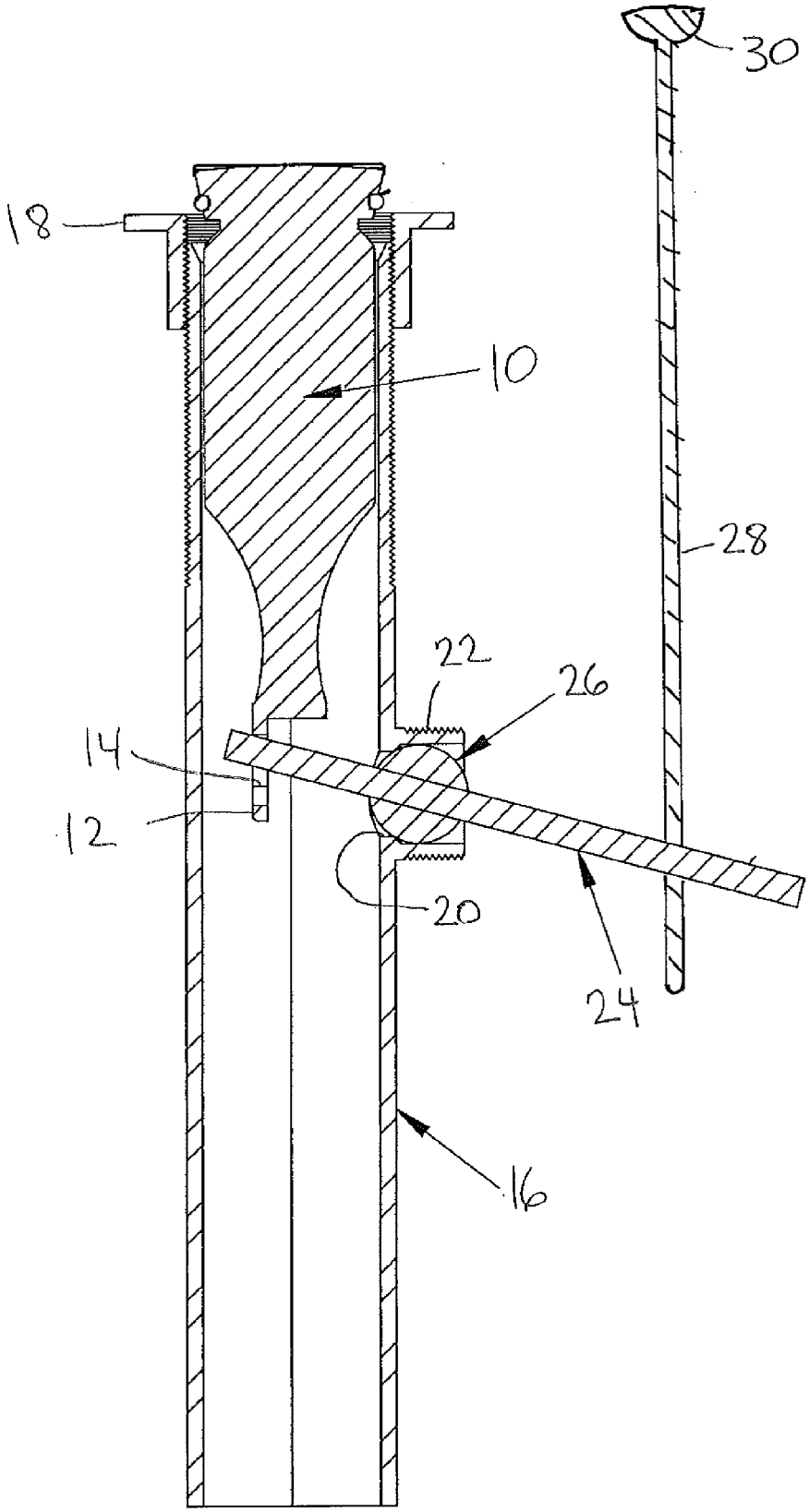
Figure 2 (Prior Art)
FIG. 2 is a cross sectional side view of a prior art embodiment of a drain stopper assembly in the open position.
Figure 3:
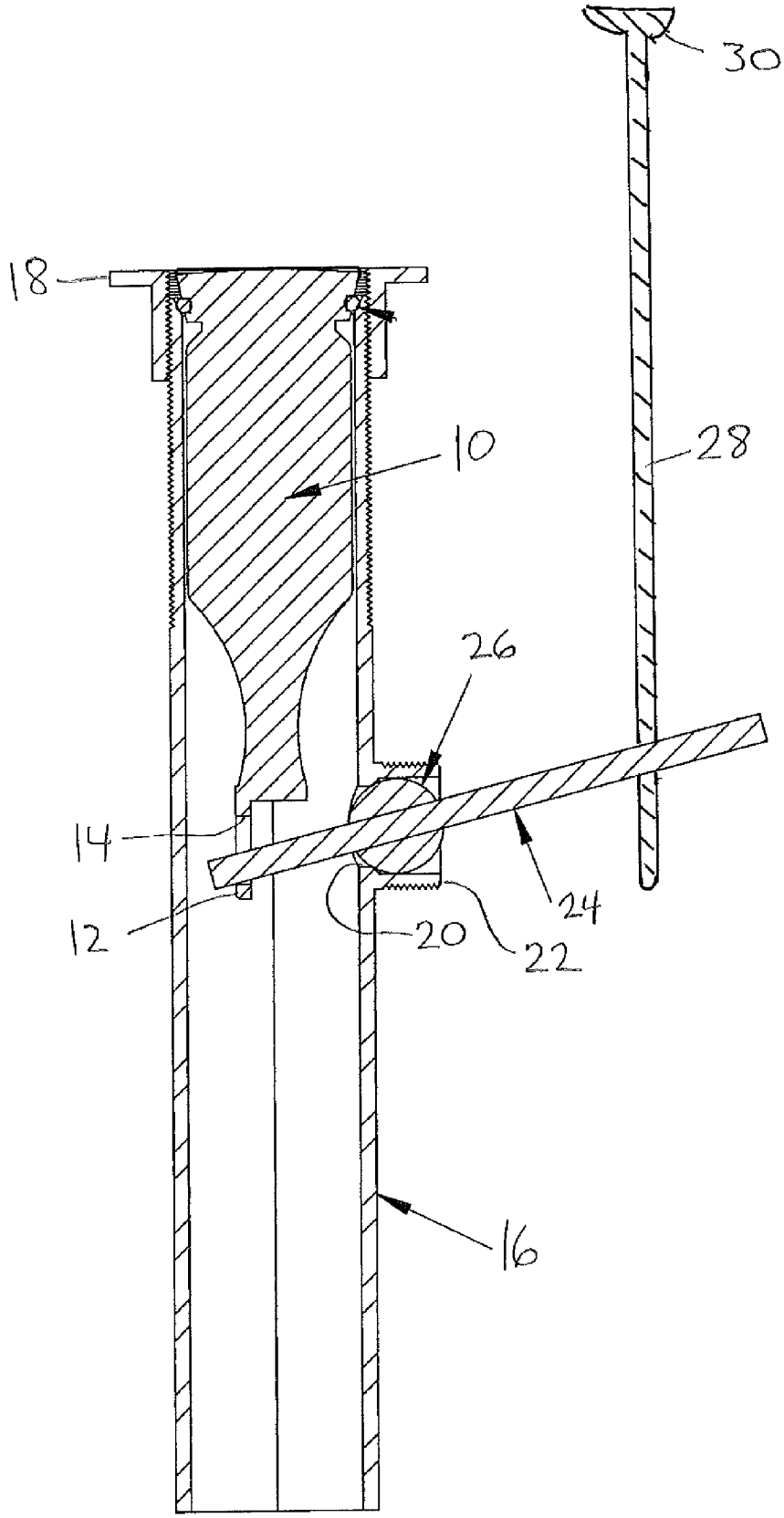
Figure 3 (Prior Art)
FIG. 3 is a cross sectional side view of a prior art embodiment of a drain stopper assembly in the closed position.

FIG. 1 illustrates a typical prior art, industry-standard drain stopper 10 with a loop or stirrup 12 at the bottom. There is an aperture 14 through the stirrup. FIGS. 2 through 3 illustrate the typical industry-standard drain stopper 10 installed in a drain pipe 16 of a sink, for example, indicated schematically at 18. The drain pipe has an opening 20 surrounded on the exterior of the pipe by an externally-threaded socket 22. An actuating lever 24 is mounted on a ball joint 26 and extends through the opening 20 in the drain pipe 16. The ball joint 26 is held in the socket 22 by an internally-threaded collar (not shown) that screws onto the socket. The collar has an opening through which the lever 24 extends. The ball joint 26 is pivotable in the socket 22 and acts as a fulcrum for the actuating lever 24. The ball joint 26 also seals the opening 20 in the drain pipe 16. The interior end of the actuating lever 24 engages the stopper 10 by extending through the aperture 14 in the stirrup 12. The exterior end of the actuating lever 24 is mechanically connected to an operating rod 28 that extends above the surface of the sink or deck and has a knob 30 that can be grasped by a user's fingers to manipulate the drain stopper 10 between an open position (FIG. 2) and a closed position (FIG. 3).

It can be seen with this prior art arrangement that removal of the stopper 10 from the drain requires disconnecting the operating rod 28 from the actuating lever 24, removal of the threaded collar from the socket 22, and withdrawal of the actuating lever 24 from the stirrup 12 to free the stopper 10 for removal from the drain pipe 16. Replacement of the drain stopper 10 requires the reversal of these steps, including the troublesome, blind threading of the actuating lever 24 back through the aperture 14 in the stirrup 12.

Figure 4:
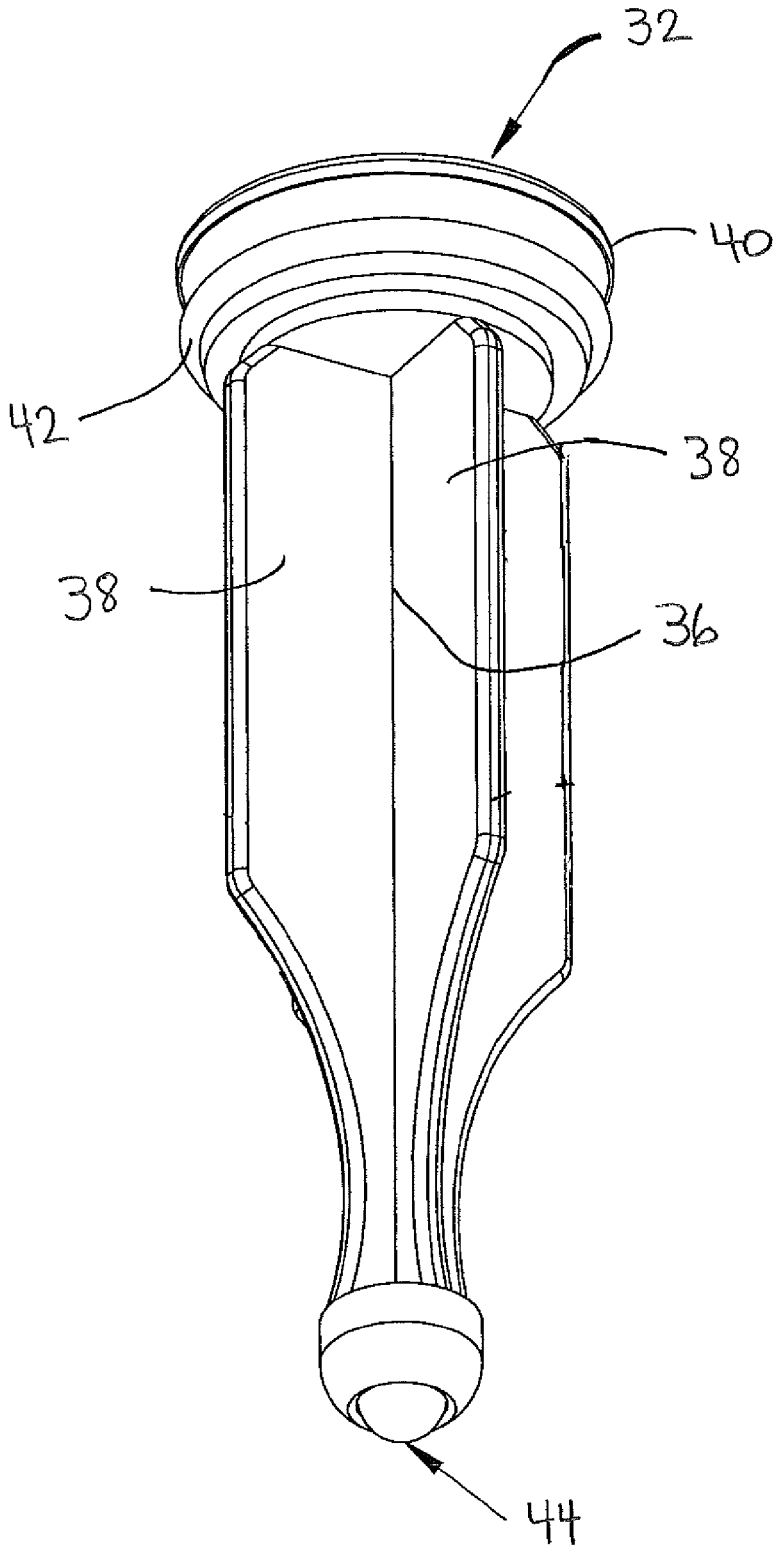
FIG. 4 is a perspective view of an embodiment of the present invention.
Figure 5:
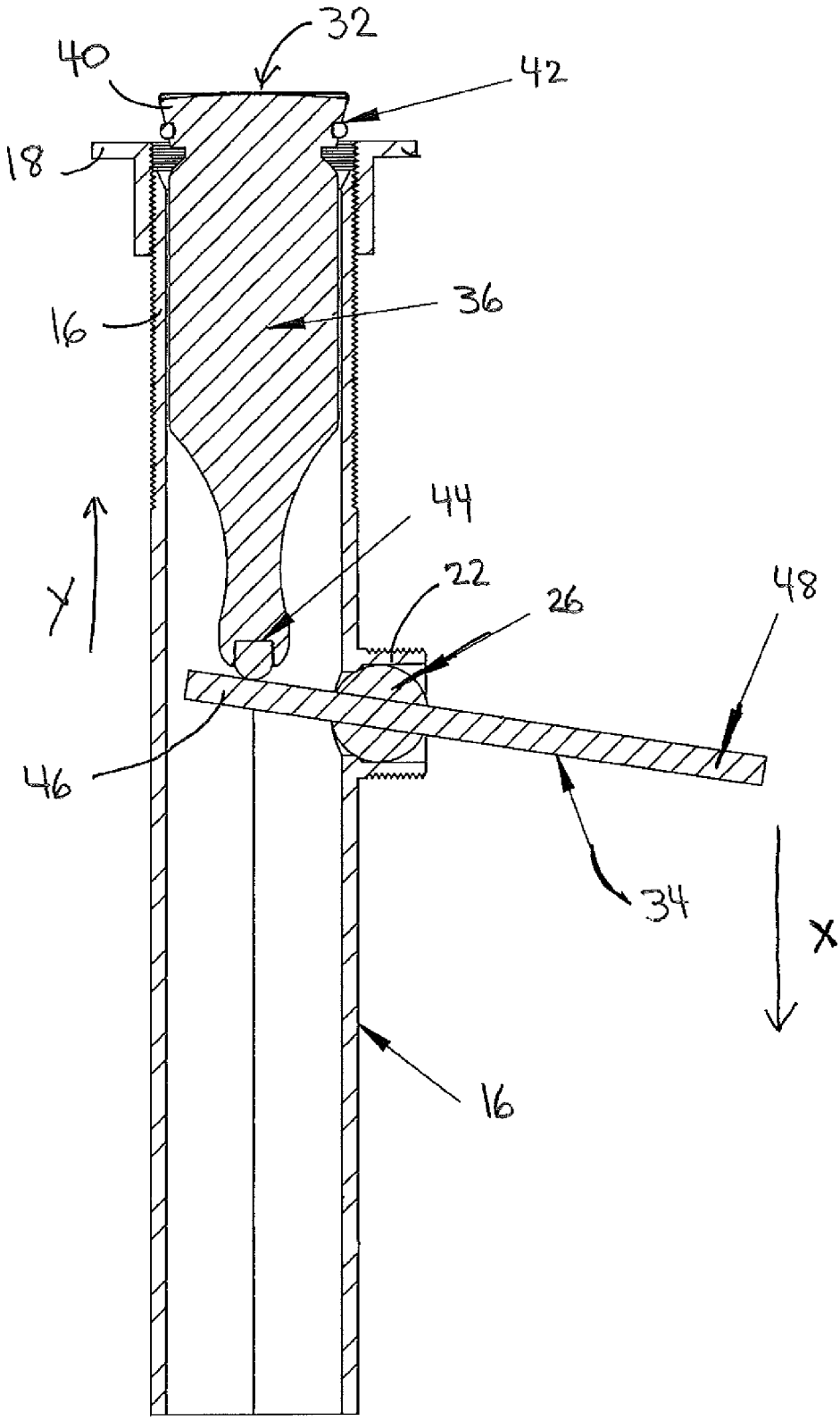
FIG. 5 is a cross sectional side view of the drain stopper assembly of FIG. 4 in the open position.
Figure 6:
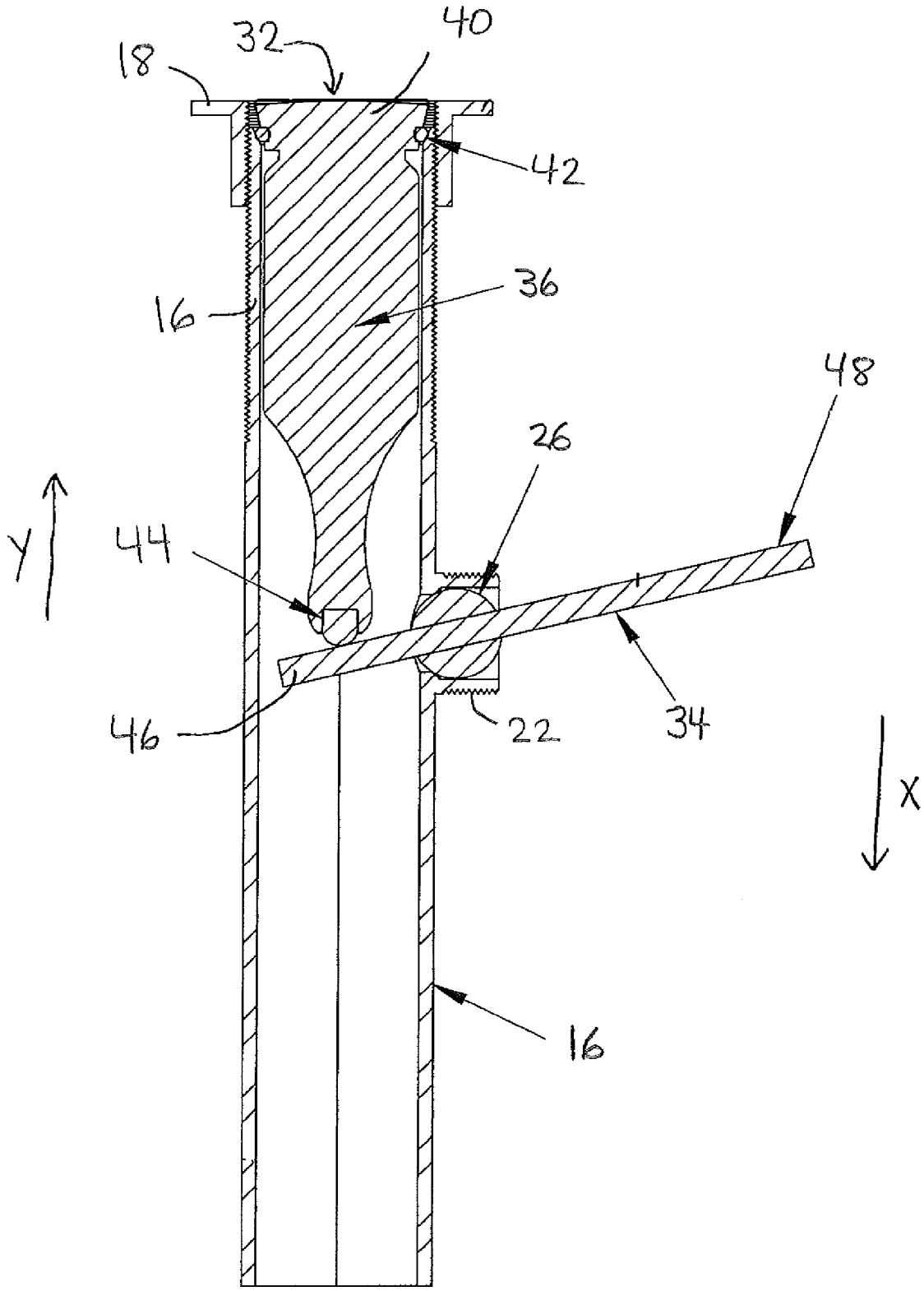
FIG. 6 is a cross sectional side view of the drain stopper assembly of FIG. 4 in the closed position.

An embodiment of the present invention is illustrated in FIGS. 4 through 6 and is generally designated as a magnetic drain stopper assembly. The magnetic drain stopper assembly includes a drain stopper 32 and a magnetic actuating lever 34. These components are mounted in an otherwise standard sink and drain assembly, whose parts will be given the same reference numbers as above and the description of which will not be repeated.

Details of the drain stopper 32 will now be described. The drain stopper includes a generally elongated body member 36. In the illustrated embodiment the body includes guide fins 38 which are sized to center the stopper in the drain pipe 16. Four fins are shown in this example but a different number could be used. The fins are circumferentially spaced at 90' to one another to permit fluid to flow between them. While it is preferable to have guide fins, they are not required. A generally disk-shaped cap 40 is attached to the top of the body member. It has a groove or seat that receives a seal 42, such as a gasket or an O-ring. The cap 40 and seal 42 are sized to close the top of the drain pipe 16 when the actuating lever is placed in the closed position of FIG. 6. The drain stopper 32 can be made of any industry-standard material such as metal or plastic, with a decorative finish on the top of the cap as desired.

The drain stopper 32 has a magnet 44 secured to the lower end of the body 36. The magnet 44 can be attached to an exterior surface of the body 36 by any industry standard method such as an adhesive or a screw. Alternatively, the magnet 44 can be encapsulated within or partially within the body 36 by any industry-standard method such as insert molding, plating or plastic or rubber coating. Yet another alternative is for the magnet 44 to be inserted into an aperture or cavity in the body 36.

The magnetic actuating lever 34 is mounted in ball joint 26. The ball joint 26 is pivotally mounted the socket 22 on the drain pipe 16. As is the case with a prior art actuating lever, the actuating lever 34 is mounted such that an interior portion 46 of the lever 34 extends into the drain pipe 16 and an exterior portion 48 of the lever 34 extends outside of the drain pipe 16. The exterior portion 48 is connected to an operating rod (not shown in FIGS. 4-6) in the usual manner.

At least the interior portion 46 of the actuating lever comprises a magnetic material. As used herein it will be understood that "magnetic material" refers to any material that has a magnetically attractive force with a magnet. For example, a magnetic material can be a metal such as steel or nickel, or a magnetic material could be a magnet. In the illustrated embodiment the lever 34 is made of steel. Alternatively, the interior portion 46 could be a magnetic material such as steel and the exterior portion 48 could be a non-magnetic material such as aluminum or plastic. Further alternative constructions of the actuating lever are described below.

As seen in FIGS. 5 and 6, the magnetic drain stopper assembly is installed in the drain pipe 16. The magnet 44 is magnetically attracted to and engages the interior portion 46 of the actuating lever 34, thereby causing the magnetic drain stopper assembly to follow the interior portion 46 of the lever 34 up and down. When the user-manipulated operating rod pushes the exterior portion 48 down, i.e., in the direction indicated by arrow x, the interior portion 46 of the actuating lever 34 moves up, i.e., in the direction indicated by arrow y, thereby pushing the magnetic drain stopper up also, as seen in FIG. 5. At a certain point of movement in direction y, the drain stopper's cap 40 and the seal 42 move out of the drain pipe 16, allowing fluid to flow into drain pipe. As seen in FIG. 6, moving exterior portion 48 up, in direction y, causes interior portion 46 to move down, in direction x. The magnetic attraction between the magnet 44 and the interior portion 46 causes the magnetic drain stopper 32 to move downwardly in the direction x also. At a certain point, movement of the magnetic drain stopper in the direction x causes the seal 42 and the cap 40 to engage with the drain pipe 16, thereby preventing fluid from flowing into drain pipe. When the drain stopper is in the closed position, as shown in FIG. 6, the magnet 44 does not have to remain in contact with the lever 46. In fact, the lever may break free from the magnet in this position. That is, the inner end of the lever 46 may move downwardly further than shown in FIG. 6 while the drain stopper 32 remain in the position of FIG. 6. This allows for loose tolerances during assembly and the use of a lower force magnet.

The magnetic drain stopper 32 can be completely removed from the drain pipe 16 by simply grasping the cap 40 and pulling with enough force to overcome the magnetic attraction between the magnet 44 and the interior portion 46 of the actuating lever. Conversely, the magnetic drain stopper 32 can be re-installed in the drain pipe 16 by simply inserting the end with the magnet 44 into the drain pipe and dropping or pushing the magnetic drain stopper assembly until the interior portion 46 and the magnet 44 are engaged by the magnetic attraction between them.

Figure 7:
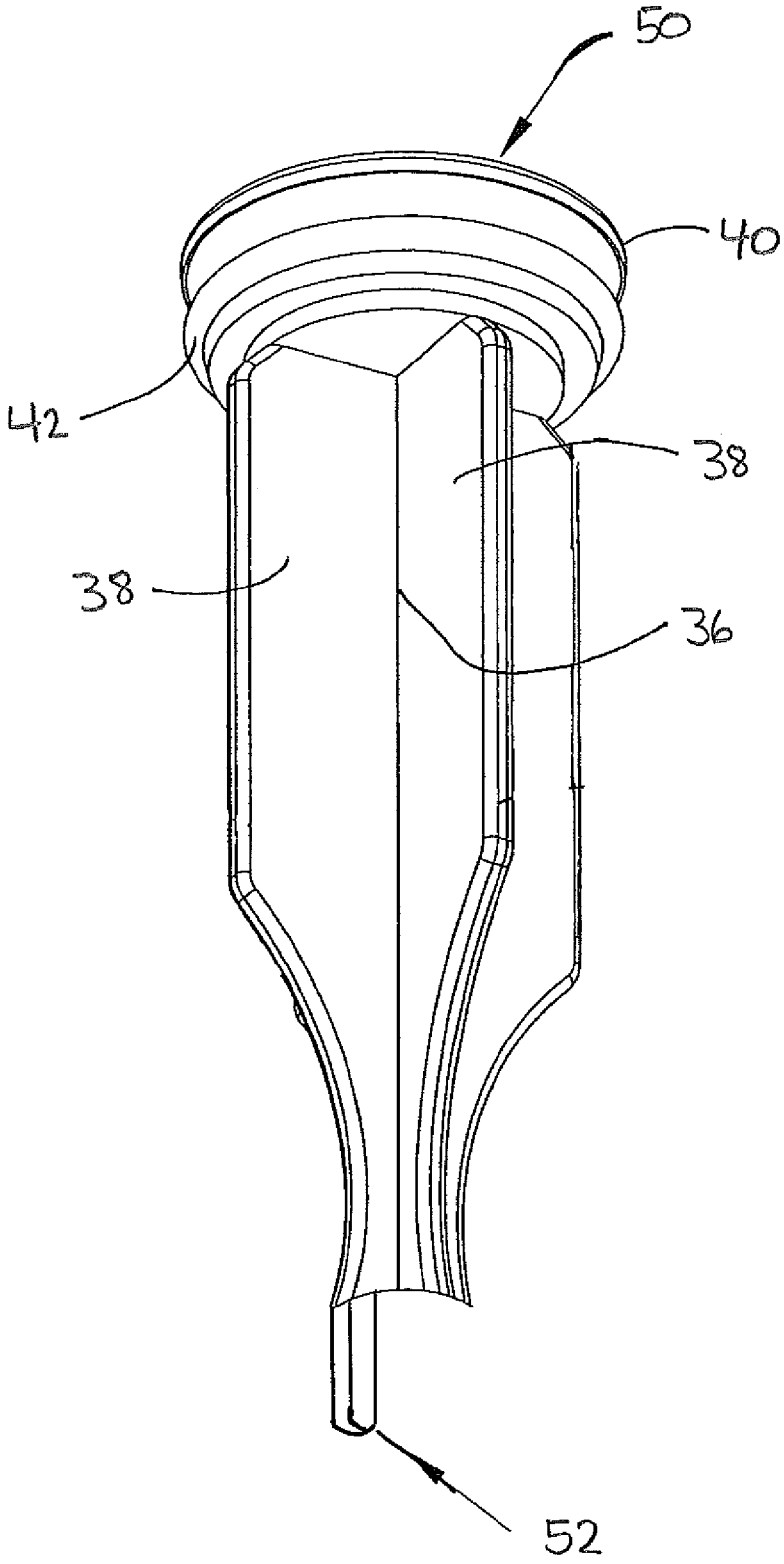
FIG. 7 is a perspective view of another embodiment of the present invention.

FIG. 7 illustrates an alternative embodiment of the magnetic drain stopper assembly in having an alternate drain stopper 50. Stopper 50 is similar to stopper 32 except the magnet 52 is offset from the central axis of the body 36. When the drain stopper 50 is installed in the drain pipe 16, the magnet should be oriented so it is on the opposite side of the pipe from the socket 22. Offsetting the magnet 52 in this manner allows the magnet 52 to engage the interior portion 46 of the magnetic actuating lever 34 farther away from the ball joint 26. This provides for a greater range of motion of the magnetic drain stopper 52.

Figure 8:
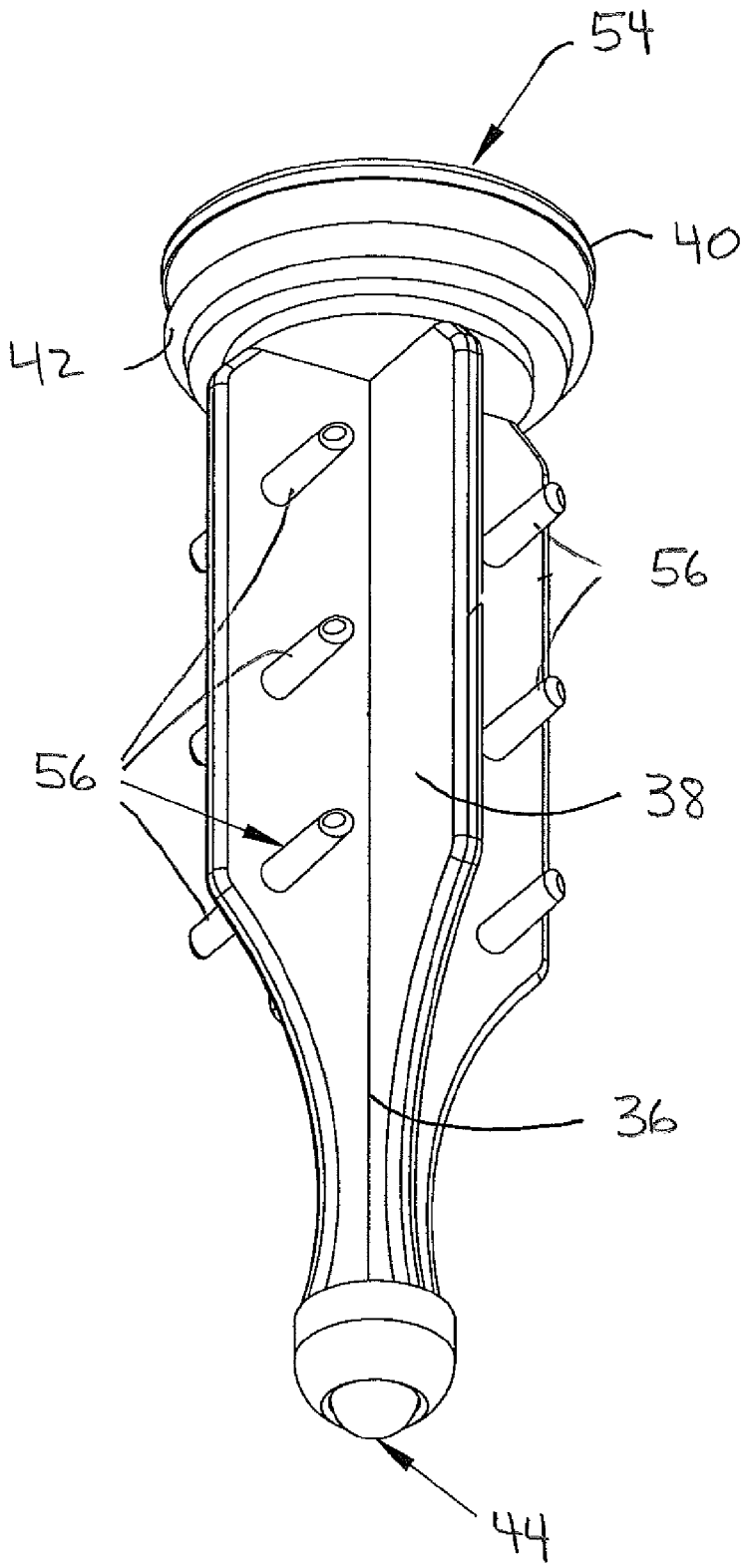
FIG. 8 is a perspective view of another embodiment of the present invention.

FIG. 8 illustrates a further alternate embodiment of a magnetic drain stopper, generally designated as 54. The magnetic drain stopper 54 can be installed in the drain pipe 16 as previously described. The magnetic drain stopper 54 has the same body 36, guide fins 38, cap 40, seal 42 and magnet 44 of the FIG. 4 embodiment. The body 36 also has a plurality of studs or pins 56. The studs 56 are sized and positioned to catch residue such as hair that enters the drain pipe. The studs will also catch valuable objects such as rings or other jewelry that may inadvertently fall in the drain pipe. The studs 56 can be made of any industry-standard material such as metal or plastic. In the illustrated example the studs 56 are integrally molded of a rigid plastic in two of the fins 38. The magnetic drain stopper 54 can be easily removed from the drain pipe as previously described. Upon removing the magnetic drain stopper 54, any objects caught in the studs 56 can be retrieved and any residue such as hair can be quickly removed without removing the ball joint and actuating lever.

Figure 9:
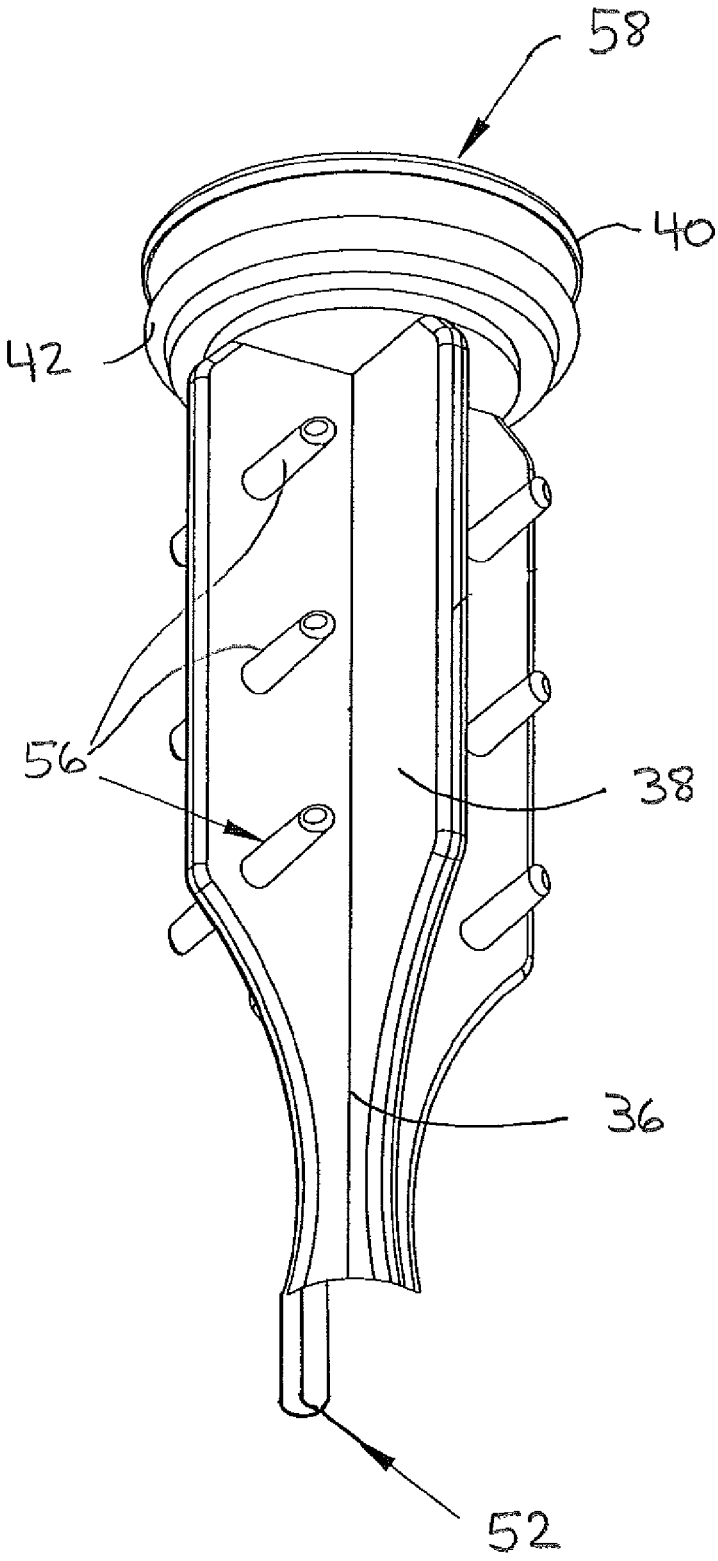
FIG. 9 is a perspective view of another embodiment of the present invention.

FIG. 9 illustrates yet another alternative embodiment of the magnetic drain stopper 58 which combines the features of the FIG. 7 and FIG. 8 embodiments. Thus, the magnet 52 is offset from the central axis of the body 36 and the body is equipped with studs 56. As described above, offsetting the magnet 52 allows the magnet to engage the interior portion 46 of the actuating lever 34 farther away from the ball joint 26, providing for a greater range of motion of the magnetic drain stopper assembly 58.

Figure 10:
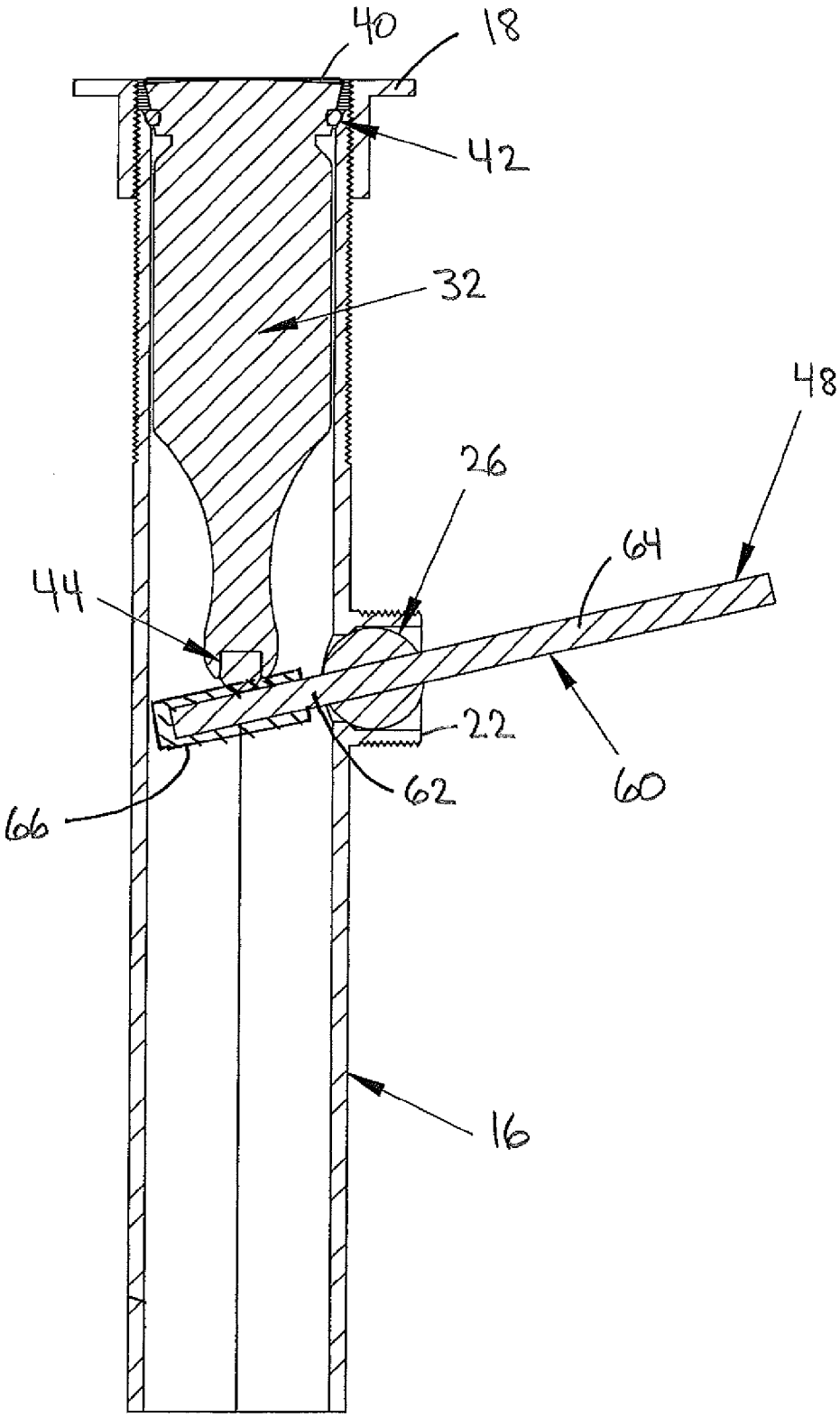
FIG. 10 is a cross sectional side view of another embodiment of the present invention.

FIG. 10 illustrates still another alternative embodiment of an actuating lever at 60. In this embodiment the interior portion 62 of lever 60 has a center core 64 made of a non-magnetic material such as aluminum or plastic. In fact, in this example, the non-magnetic core extends the entire length of the lever. A sleeve 66 is provided to cover at least a portion of interior portion 62. The sleeve 66 can be made out of any magnetic material, such as steel or a magnet. The sleeve 66 can be flexible such as a wrap or tape, or the sleeve can be rigid such as a tube. In the illustrated example the sleeve is a rigid steel cylinder that slides over the interior portion 62 of the lever 60. One end of the sleeve may be open and the other end closed, as shown, or both ends of the sleeve could be open. The sleeve 66 provides magnetic attraction to either magnet 44 of magnetic drain stopper 32 or magnet 52 of magnetic drain stopper 50.

It can be seen that the embodiment of FIG. 10 lends itself to retrofitting existing sinks having a standard actuating lever. A kit including a drain stopper, of any of the above versions, and at least one sleeve 66 can be supplied for the retrofit. The process for installing the retrofit includes disconnecting the operating rod from the actuating lever. Next the installer removes the retaining collar from the socket and pulls out the existing actuating lever and ball joint. Then the existing drain stopper can be removed from the drain pipe. The installer then checks the actuating lever to see if it is made of magnetic material. This can be readily done by placing the magnet of the drain stopper next to the lever and then trying to separate them slowly. If a noticeable attraction is felt, the lever is made of magnetic material. In that case the actuating lever and its ball joint can be replaced into the side opening and socket of the drain pipe without any changes. If the existing actuating lever is not made of magnetic material the sleeve 66 is installed on the interior end of the actuating lever. Preferably the sleeve is secured to the interior end of the actuating lever by suitable means, such as adhesive or a press fit. The kit may include several sleeves of varying lengths and internal diameters, with the user selecting the size appropriate for the particular drain diameter and actuating lever diameter. Once the sleeve is in place on the lever, the actuating lever and its ball joint can be replaced into the side opening and socket of the drain pipe. The retaining collar is threaded back on the socket and the operating rod is reconnected to the actuating lever. Finally, the drain stopper of the present invention is simply dropped into the drain. The magnet on the bottom of the drain stopper engages the sleeve, if present, or the actuating lever, if no sleeve is present. At least one of the sleeve and actuating lever is made of magnetic material. Accordingly, the drain stopper is magnetically connected to the actuating lever and will move up and down therewith.

While the preferred form of the invention has been shown and described herein, it should be realized that there may be many modifications, substitutions and alterations thereto without departing from the scope of the following claims. For example, while the magnetic drain stopper assembly is shown in a sink, it can also be used in other settings such as a bathtub or a utility tub. The body can have a different number of guide fins such as three or the body can have a different form not having any guide fins, such as a hollow cylinder. The magnet can be a shape other than rounded, such as square, rectangular or polygonal.

We claim:

1. A drain stopper assembly for opening and closing the top opening of a drain pipe, the drain pipe having a side opening spaced from the top opening, the drain stopper assembly comprising:

a drain stopper including a body sized for insertion into the drain pipe, a cap attached to the top of the body and sized for selectably closing the top opening of the drain pipe and a magnet attached to the body at a location spaced from the cap;

an actuating lever pivotally mountable in the side opening of the drain pipe and having an interior portion inside the drain pipe and an exterior portion outside the drain pipe when the actuating lever is mounted in the side opening, at least the interior portion including a magnetic material for engagement with the magnet of the drain stopper, and wherein the actuating lever comprises a core of non-magnetic material; and a sleeve of magnetic material covering at least some of the interior portion of the actuating lever.

2. The drain stopper assembly of claim 1 wherein the sleeve is made of steel.

3. The drain stopper assembly of claim 1 wherein the magnet is attached to the end of the body opposite the cap.

4. The drain stopper assembly of claim 3 wherein the magnet is at least partially exposed.

5. The drain stopper assembly of claim 3 wherein the magnet is waterproof.

6. The drain stopper assembly of claim 3 wherein the magnet is coated with a waterproof material.

7. The drain stopper assembly of claim 3 wherein the magnet is sealed within the drain stopper.

8. The drain stopper assembly of claim 1 further comprising at least one stud extending from the body.

9. The drain stopper assembly of claim 1 further comprising a seal mounted on the cap.

10. The drain stopper assembly of claim 9 wherein the seal is an O-ring.

11. A kit for providing a drain stopper assembly to engage a drain pipe, comprising:

a drain stopper having a magnet attached thereto;

at least one metal sleeve that at least partially covers an actuating lever extending into the drain pipe such that the magnet interacts magnetically with the metal sleeve;

the actuating lever being selectably movable between a first position wherein the actuating lever pushes the drain stopper into an open position, thereby allowing fluid flow into the drain pipe; and a second position wherein the actuating lever causes the drain stopper to move into a closed position, thereby preventing fluid flow into the drain pipe.

12. A method of retrofitting a sink drain assembly of the type having a drain stopper which is mechanically linked to an actuating lever in a drain pipe, comprising the steps of:

disengaging the mechanically linked drain stopper from the actuating lever by removing the actuating lever from the drain pipe;

removing the disengaged drain stopper from the drain pipe;

checking whether the actuating lever is made of magnetic material and if it is not made of magnetic material placing a sleeve made of magnetic material over the interior end portion of the actuating lever;

replacing the actuating lever in the drain pipe; and placing a magnetic drain stopper in the drain pipe wherein a magnet attached to the magnetic drain stopper interacts magnetically with the actuating lever.

13. A method of retrofitting a sink drain assembly of the type having a drain stopper which is mechanically linked to an actuating lever made of magnetic material in a drain pipe, comprising the steps of:

disengaging the mechanically linked drain stopper from the actuating lever by removing the actuating lever from the drain pipe;

removing the disengaged drain stopper from the drain pipe;

replacing the actuating lever in the drain pipe; and placing a magnetic drain stopper in the drain pipe wherein a magnet attached to the magnetic drain stopper interacts magnetically with the actuating lever.

* * * * *